US010400798B2

(12) United States Patent
Buchholz

(10) Patent No.: US 10,400,798 B2
(45) Date of Patent: Sep. 3, 2019

(54) HYDRAULIC UNIT FOR A MOBILE HYDRAULIC TOOL

(71) Applicant: TKR Spezialwerkzeuge GmbH, Gevelsberg (DE)

(72) Inventor: Karl Buchholz, Schwerte (DE)

(73) Assignee: TKR Spezialwerkzeuge GmbH, Gevelsberg (DE)

( * ) Notice: Subject to any disclaimer, the term of this patent is extended or adjusted under 35 U.S.C. 154(b) by 362 days.

(21) Appl. No.: 15/343,048

(22) Filed: Nov. 3, 2016

(65) Prior Publication Data

US 2017/0122346 A1 May 4, 2017

(30) Foreign Application Priority Data

Nov. 3, 2015 (DE) ..... 10 2015 118 839

(51) Int. Cl.
*B25F 5/00* (2006.01)
*F15B 15/20* (2006.01)
*F15B 15/14* (2006.01)

(52) U.S. Cl.
CPC ..... *F15B 15/1447* (2013.01); *B25F 5/005* (2013.01); *F15B 15/204* (2013.01)

(58) Field of Classification Search
CPC ... B21J 15/06; B21J 15/12; B21J 15/20; B21J 15/105; B21J 15/205; B21J 15/22; B21J 15/28; B21J 15/285; F15B 15/1447; F15B 15/24; F15B 15/204; F15B 15/202; B25F 5/005
USPC ... 92/9, 10, 11, 12, 109, 110, 113, 114, 115, 92/183, 181 R, 184, 181 P; 91/224
See application file for complete search history.

(56) References Cited

U.S. PATENT DOCUMENTS 3,052,099 A * 9/1962 Van Hecke ..... B21J 15/022 173/169
3,806,870 A * 4/1974 Kalajian ..... B60Q 1/441 200/82 D
4,633,665 A * 1/1987 Buter ..... F15B 1/02 60/413
6,035,634 A 3/2000 Tupper et al.
(Continued)

FOREIGN PATENT DOCUMENTS

EP 0 787 563 A1 8/1997
EP 2 786 843 A2 10/2014

OTHER PUBLICATIONS

Extended European Search Report dated Apr. 5, 2017 in European Application No. 16195042.3 (6 pages) (German only).

*Primary Examiner* — Thomas E Lazo
*Assistant Examiner* — Dustin T Nguyen
(74) *Attorney, Agent, or Firm* — Nixon Peabody LLP

(57) ABSTRACT

The invention relates to a hydraulic unit for a mobile hydraulic tool with a hydraulic piston hydraulically adjustable between a starting position and an end position and a piston rod that is connected to the hydraulic piston and has a tool holder for a tool insert. In order to provide a hydraulic unit for a mobile hydraulic tool that enables the use of tool inserts with different load bearing capacity, it is provided that a pressure control valve connecting the pressure chamber to a cylinder chamber and limiting the pressure acting on a hydraulic piston on the pressure chamber side is arranged on the hydraulic piston and is connected to the piston rod such that a response pressure of the pressure control valve can be adjusted by the piston rod.

8 Claims, 7 Drawing Sheets

(56) References Cited

U.S. PATENT DOCUMENTS 8,307,690 B2 * 11/2012 Cobzaru ..... B21J 15/043
72/453.17
9,162,353 B2 * 10/2015 Ciotti ..... B25F 3/00

* cited by examiner

HYDRAULIC UNIT FOR A MOBILE HYDRAULIC TOOL

BACKGROUND OF THE INVENTION

Field of the Invention

The invention relates to a hydraulic unit for a mobile hydraulic tool comprising:

- a hydraulic piston hydraulically adjustable between a starting position and an end position and
- a piston rod that is connected to the hydraulic piston and has a tool holder for a tool insert.

Description of Related Art

Hydraulic tools of the aforementioned kind are for example used in workshops to carry out punching processes or set rivets in repair tasks on vehicles. The tool inserts are selected corresponding to the tasks to be performed, wherein they are, for example, punch inserts or tool dies that dictate the shape of the riveting heads. When the hydraulic tool is actuated, the hydraulic piston is moved out of its starting position toward its end position due to the pressure in the hydraulic unit. The movement of the hydraulic piston is transmitted by the piston rod connected to the hydraulic piston to the tool insert arranged in the tool holder of the piston rod.

Due to the increasing use of high-strength materials in the field of motor vehicle construction, an increasing need exists in motor vehicle workshops for hydraulic tools with hydraulic units that apply greater pressure. However, the problem exists that tool inserts already existing in the workshops are not designed for the use of higher pressure which makes it necessary to procure completely new tool inserts for the new hydraulic tools. Furthermore, the danger exists of accidentally using the existing tool inserts that only withstand lesser pressures and then break during operation which leads to the endangerment of surrounding persons.

BRIEF SUMMARY OF THE INVENTION

Against this background, the object of the invention is to provide a hydraulic unit for a mobile hydraulic tool which makes it possible to use tool inserts with different load bearing capacities.

The invention achieves the object by a hydraulic unit having the features of claim 1. Advantageous further embodiments of the invention are specified in the dependent claims.

It is characteristic of the hydraulic unit according to the invention that a pressure control valve connecting the pressure chamber to a cylinder chamber and limiting the pressure acting on the hydraulic piston on the pressure chamber side is arranged on the hydraulic piston and is connected to the piston rod such that a response pressure of the pressure control valve can be adjusted by the piston rod.

According to the invention, a pressure control valve is arranged on the hydraulic piston that connects the pressure chamber, in which the pressure is applied that is required to move the hydraulic piston out of the starting position toward the end position, to the cylinder chamber that is adjacent to the hydraulic piston on the side opposite the pressure chamber. Depending on the adjustment of the pressure control valve, the pressure control valve is opened in a pressure limiting manner when a response pressure is exceeded, and the hydraulic fluid is guided out of the pressure chamber into the cylinder chamber. By the pressure control valve, the maximum hydraulic pressure acting on the hydraulic piston and hence on the piston rod and the tool insert arranged their can be limited. An adjustment of the pressure control valve by the piston rod is possible according to the invention so that it can be conveniently adjusted using an existing component. The maximum operating pressure on the tool insert can hence be easily set by means of the hydraulic piston.

The design of the connection of the piston rod, designed to receive the tool inserts, to the hydraulic piston so that the pressure control valve is adjustable by means of the piston rod is freely selectable in principle. For example, a design is conceivable according to which an adjustment of the pressure control valve is brought about by rotating the piston rod. However according to one particularly advantageous embodiment of the invention, the piston rod has a control rod which at one end is arranged in the tool holder and can be brought into engagement with a tool insert, and the other end is connected to the pressure control valve such that an adjustment of the control rod causes a change in the response pressure of the pressure control valve.

According to this embodiment of the invention, a separate control rod that extends on the piston rod from the pressure control valve into the tool holder serves to make a setting of the pressure valve. The control rod can accordingly be specially adapted as a separate component to the pressure control valve without major adaptations to the piston rod being necessary. By adjusting the control rod, which offers favorable accessibility by the existing arrangement at one end in the tool holder, thus the response pressure of the pressure control valve can be easily set.

For example, it is conceivable to cause the response pressure to be set by rotating the control rod. According to one particularly advantageous embodiment of the invention, however, a shift of the control rod in the direction of the longitudinal axis causes a change in the response pressure of the pressure control valve. According to this embodiment of the invention, the response pressure is defined depending on the shift of the control rod in the direction of the longitudinal axis towards or respectively away from the pressure control valve. This embodiment of the invention makes it possible to adjust the control rod by the tool insert arranged in the tool holder such that, given a corresponding design of the tool insert, the tool insert installed in the tool holder in the position with the control rod engaged independently limits the maximum load. A separate setting of the response pressure before arranging a tool insert in the tool holder can, therefore, be omitted since, due to the arrangement of the tool insert, the pressure control valve is automatically arranged in the position specified for the respective tool insert. Given this embodiment of the invention, a downward compatibility is achieved i.e., also tool inserts with a low load limit can be used in a hydraulic tool designed for higher pressures.

In principle, the pressure control valve can be designed in any way so that a change in the response pressure is caused by moving the control rod. However, according to one particularly advantageous embodiment of the invention, the pressure control valve has a stop element that can be adjusted in the direction of the longitudinal axis of the control rod, and against which the control rod abuts at the one end and, at the other end, a spring element abuts which, at an end opposite the stop element, abuts a valve element that closes an inlet duct of the pressure control valve, wherein the settable length of the spring element defines the bias of the response pressure. According to this embodiment of the invention, the valve element is biased by a spring element, wherein the response pressure of the pressure control valve is established by the bias. The level of the bias is defined by the position of the stop element against which the spring element abuts with its end opposite the valve body. An adjustment of the stop element toward the valve element accordingly causes an increase in the bias, and thereby increases the response pressure of the pressure control valve. A displacement of the stop element in the opposite direction contrastingly reduces the response pressure of the pressure control valve. Accordingly, the response pressure of the pressure control valve can be easily set by an axial displacement of the stop element, wherein the control rod defines the position of the stop element by its position in the direction of the longitudinal axis.

In principle, any elements can be used as the spring elements which generate a bias depending on the length. According to one particularly advantageous embodiment of the invention, the spring element is formed by a helical pressure spring braced at one end against the stop element and at the other end against the valve element. A helical pressure spring can be used to set the response pressure in a particularly easy and economical manner.

According to another embodiment of the invention, a setscrew which can be moved in a longitudinal axial direction is arranged on the side of the stop element opposite the spring element. According to this embodiment of the invention, the setscrew restricts the mobility of the stop element due to the spring bias and accordingly establishes the response pressure of the pressure control valve when the stop element is in an unloaded state. The ability to adjust the setscrew toward the spring element, or respectively away therefrom, it is possible to change the existing response pressure as needed when the stop element is in an unloaded state. The setscrew is designed such that the control rod can be guided through it without blockage such that the stop element can be moved toward the spring element by the control rod, and the response pressure can thereby be increased. The setscrew can be moved once before assembling the hydraulic unit. However, the option also exists of changing the position of the setscrew in an assembled state using a suitable tool.

A flow duct for the hydraulic fluid entering the cylinder chamber from the pressure chamber in the event of opening the pressure control valve, can in principle be designed in a desired manner. However according to one particularly advantageous embodiment of the invention, the hydraulic piston and the control rod are designed such that, after the response pressure is reached, the hydraulic fluid enters an overpressure duct in the hydraulic piston open to the cylinder chamber coaxial to the control rod. This embodiment of the invention enables a particularly compact and simple design of the hydraulic piston, since a hole that is already available for the control rod can be used to conduct the overflowing hydraulic fluid to an overpressure duct that terminates in the cylinder chamber.

In principle, the position of the control rod can be established, and hence the adjustment of the pressure control valve, can be set in any desired manner. For example, the possibility exists of designing the tool inserts with different lengths corresponding to their load bearing capacity so that, in their position arranged in the tool holder, an end face abuts the control rod and moves it into the location assigned to the corresponding response pressure of the pressure control valve. The possibility also exists of designing the length of the tool insert so that it does not abut the control rod in the assembled position, so that the response pressure of the pressure control valve then corresponds to the unloaded state of the control rod.

According to one particularly advantageous embodiment of the invention, the tool inserts are used for this purpose, however, and have recesses adapted to the tool insert section of the control rod along the extension of which the response pressure can be adjusted in the longitudinal direction of the axis. According to this embodiment of the invention, the individual tools can have recesses, the length of which dimensioned such that they arrange the control rod in a position in which the response pressure corresponds to the maximum load of the tool insert. The respective tool insert hence independently establishes the position of the control rod and thus the response pressure. In the event that limitation is not required, the tool insert can also have no recesses, and only abuts the control rod with a flat end and pushes it toward the pressure control valve to the maximum extent so that the maximum response pressure is set which can lie above the maximum generatable hydraulic pressure which is equivalent to closing the pressure control valve. A recess with an extensive length in the direction of the longitudinal axis contrastingly results in an unloaded state of the control rod such that the response pressure set by a setscrew is applied.

The arrangement of the tool inserts in the tool holder is freely selectable in principle. According to one particularly advantageous embodiment, however, the tool holder has a thread for arranging the tool inserts. A screwable arrangement of the tool inserts in the tool holder yields particularly secure and reliable positioning of the tool inserts and hence an effective adjustment of the respective response pressures.

BRIEF DESCRIPTION OF THE SEVERAL VIEWS OF THE DRAWINGS

An exemplary embodiment of the invention is explained below with reference to the drawings. In the drawings.

DETAILED DESCRIPTION OF THE INVENTION

Figure 1:
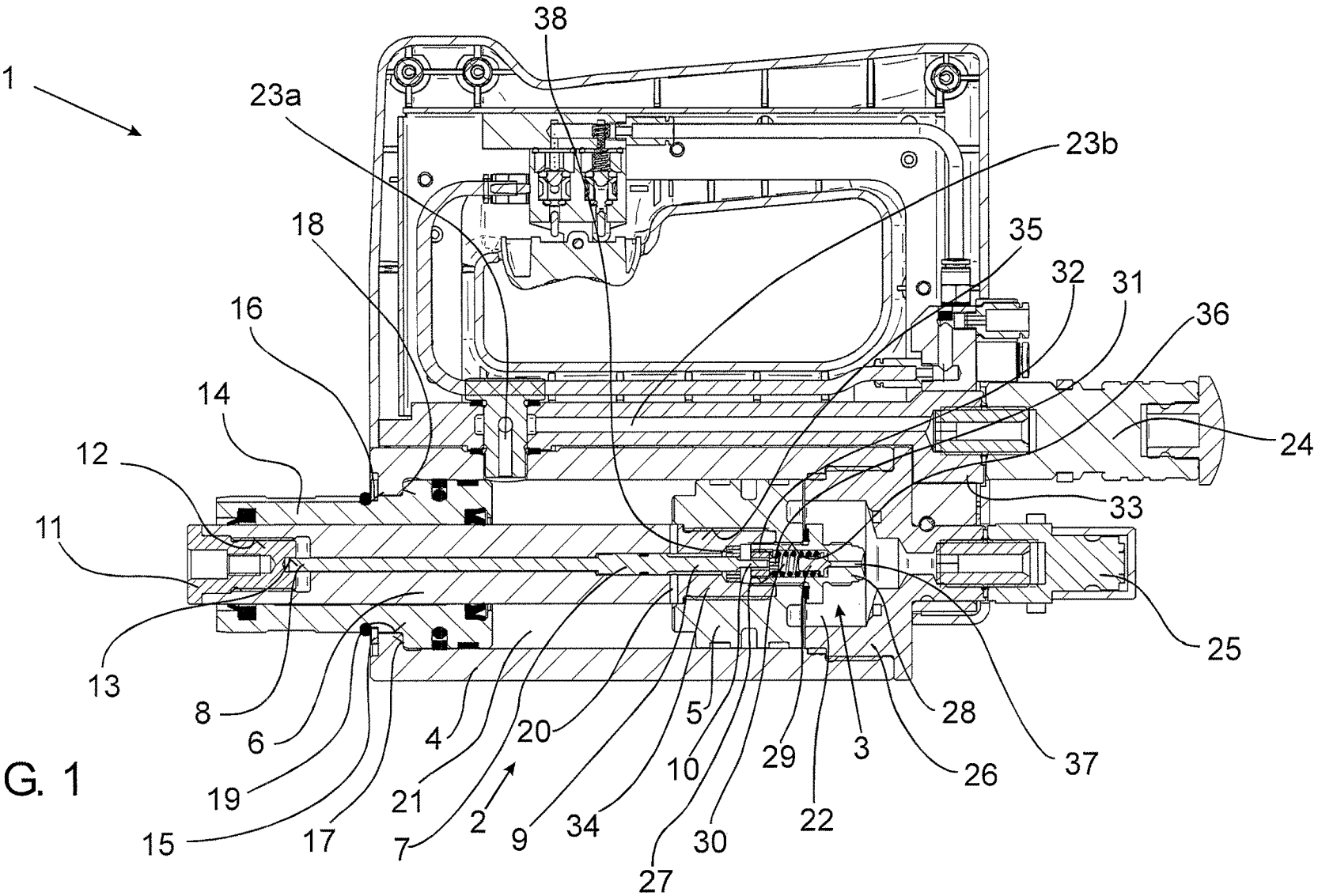
FIG. 1 shows a view of a section of a hydraulic tool.
Figure 2:
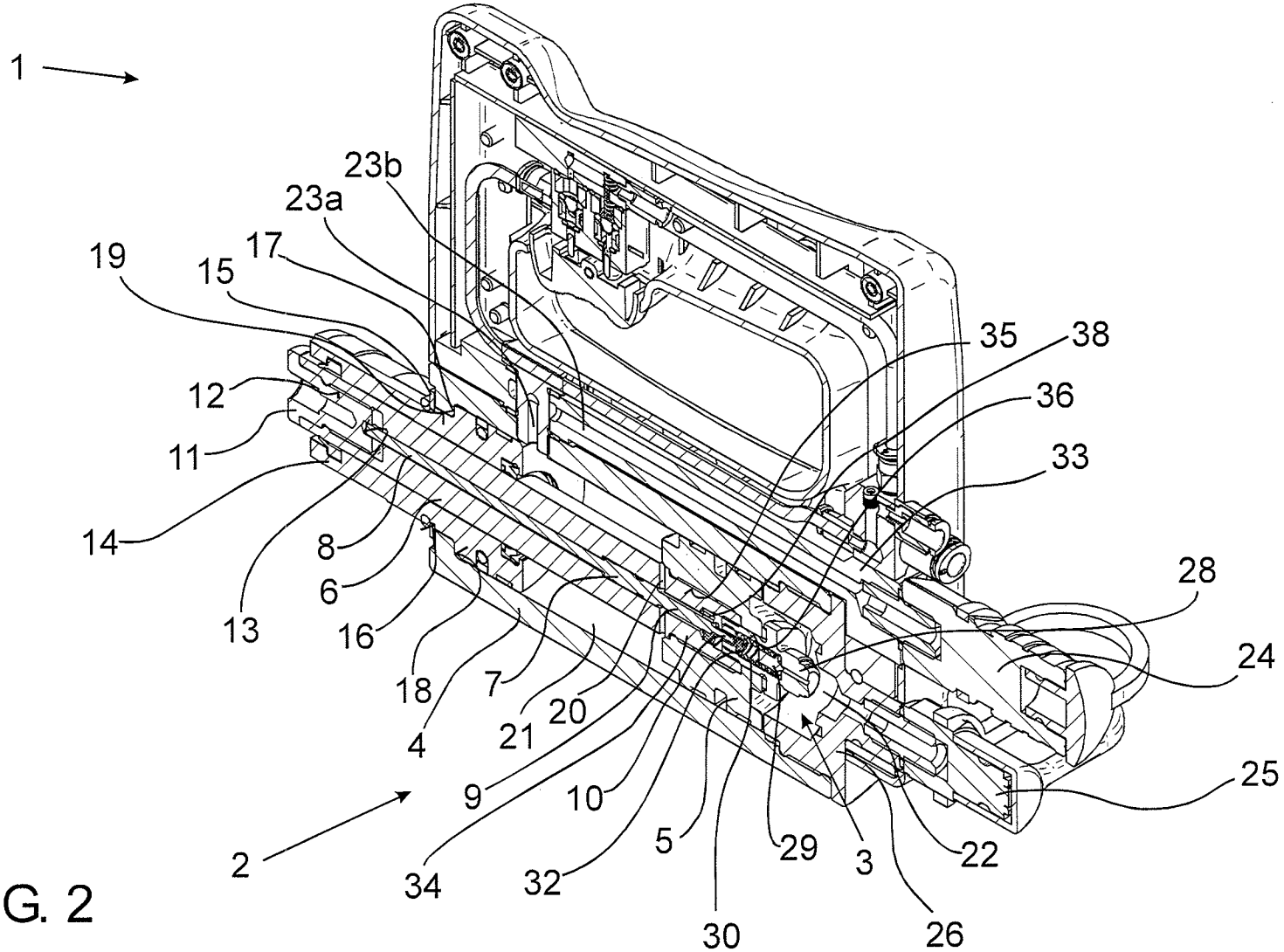
FIG. 2 shows a perspective view of a section of the hydraulic tool from FIG. 1.
Figure 3:
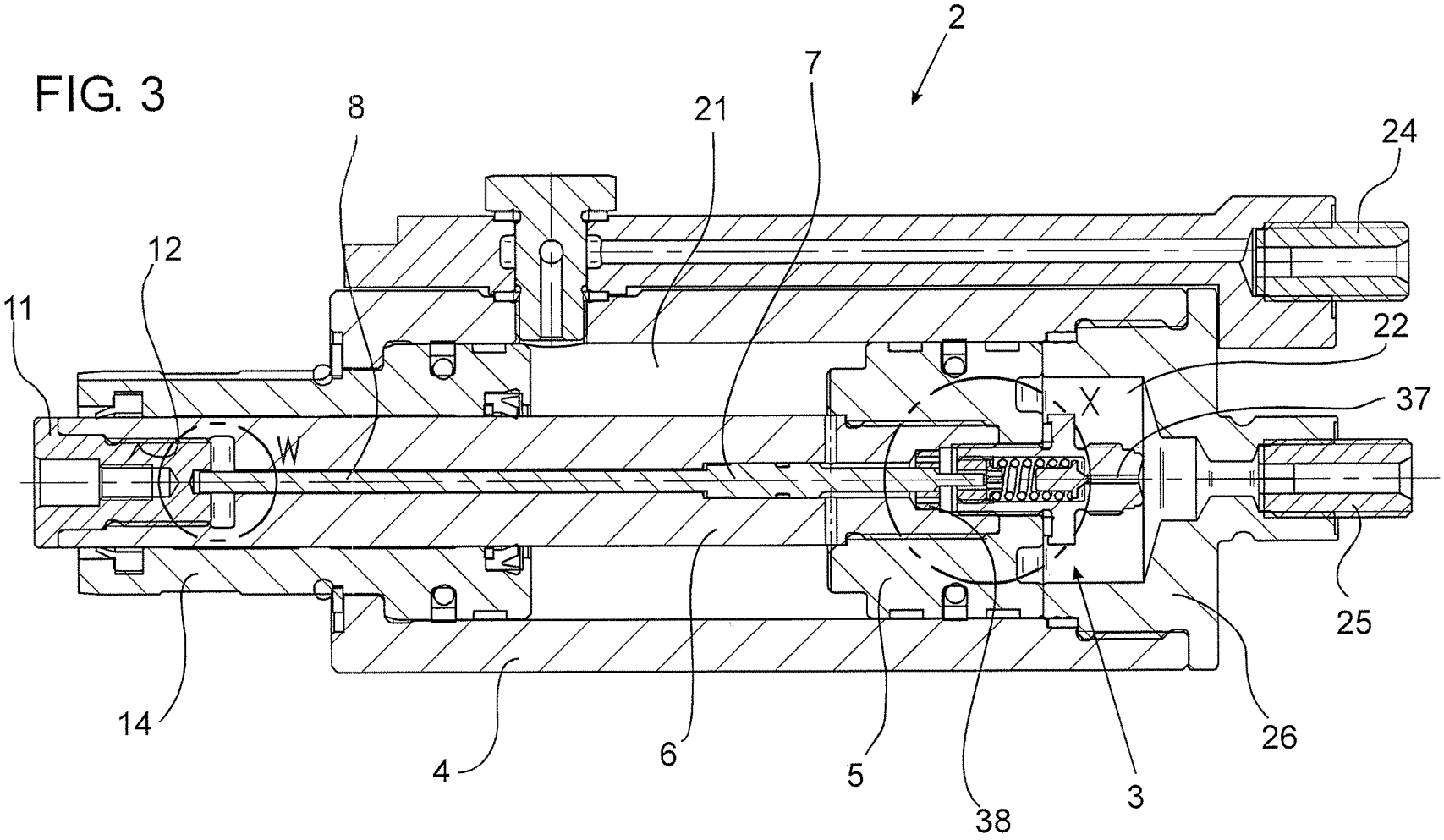
FIG. 3 shows a view of a section of a hydraulic unit of the hydraulic tool from FIG. 1.
Figure 3B:
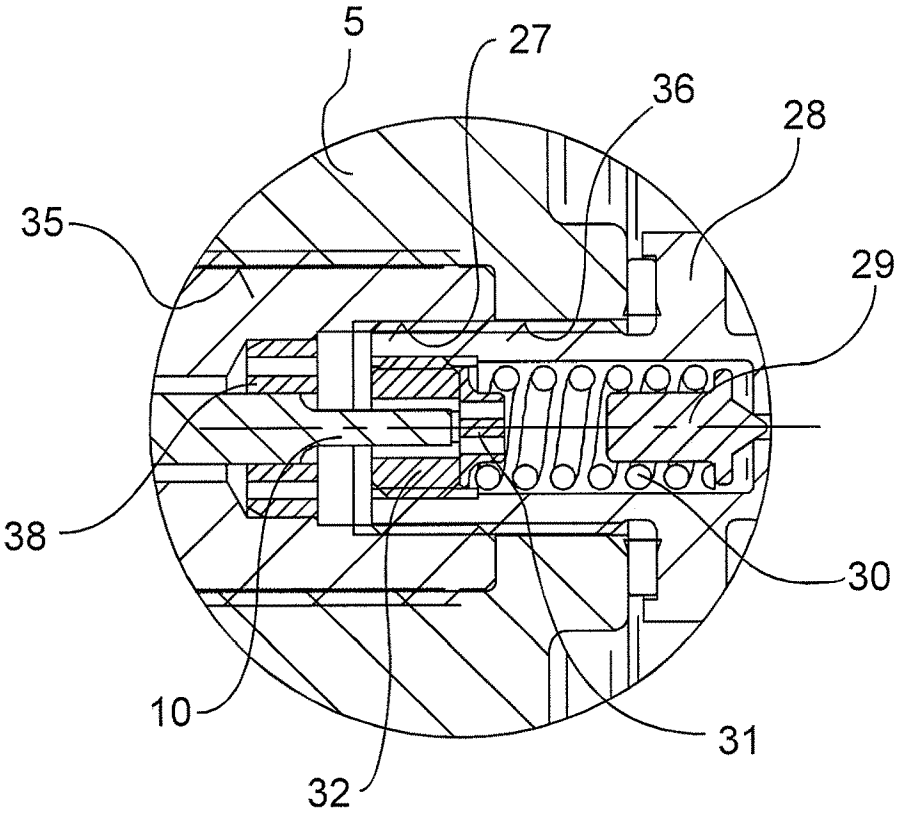
FIG. 3*b* shows a view of detail X from FIG. 3.
Figure 3A:
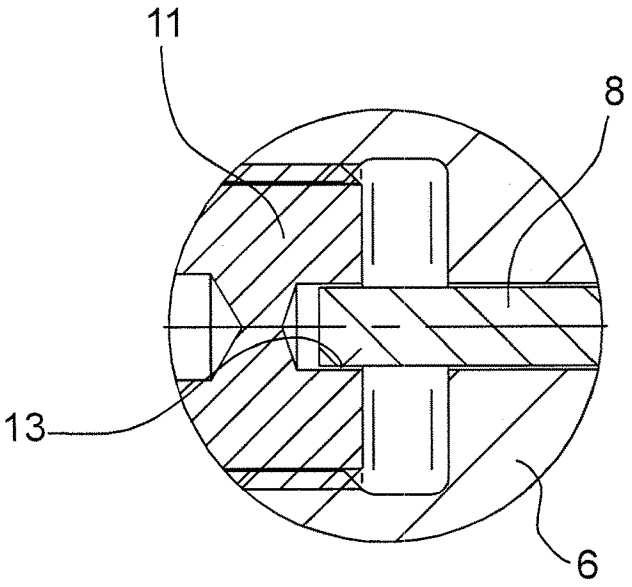
FIG. 3*a* shows a view of detail W from FIG. 3.

FIG. 1 shows a sectional view of a hydraulic tool 1. The core of the hydraulic tool 1 is a hydraulic unit 2 arranged on a housing body 33 by means of which the required operating pressure is generated. The hydraulic unit 2 has a cylinder 4 within which a hydraulic piston 5 can be moved from the starting position shown in FIGS. 1 to 3 toward an end position. To move the hydraulic piston 5, a pressure chamber 22 is pressurized by means of a hydraulic fluid supplied by a coupling 25 connected to a cylinder cover 26. Due to the hydraulic pressure, the hydraulic piston 5 is moved, by means of which a piston rod 6 connected to the hydraulic piston 5 is also moved, and the end of said piston rod facing the hydraulic piston 5 has a tool holder 12 for a tool insert designed as a die 11. The piston rod 6 is guided liquid-tight in a guide sleeve 14 arranged in an opening 19 of the cylinder 4. In the extending direction of the hydraulic piston, the position of the guide sleeve 14 is established by the contact of a shoulder 17 on an edge 18 of the opening 19. In the opposite direction, the position of the guide sleeve 14 is secured by a spring ring 15 which engages in a groove 16 in the guide sleeve 14.

A pressure control valve 3 is mounted on the hydraulic piston 5, wherein the pressure control valve 3 with an inlet duct 37 is arranged in the pressure chamber 22. The response pressure of the pressure control valve 3 is determined by a helical pressure spring 30, one end of which abuts a valve element 29 that closes the inlet duct 37, and the other end of which abuts a stop element 31 which can be moved axially toward the helical pressure spring 30 and away from it.

Accordingly, the bias of the helical pressure spring 30 and hence the response pressure of the pressure control valve 3 can be determined by the position of the stop element 31. With its side opposite the helical pressure spring 30, the stop element 31 abuts a setscrew 32 which accordingly establishes the response pressure when the stop element 31 is in an unloaded state. The setscrew 32 can be adjusted in the direction toward the helical pressure spring 30, or respectively away from it. To move the stop element 31 out of its position in which it abuts the setscrew 32, the piston rod 6 has a control rod 7 running axially thereto with an end section 10 that abuts the stop element 31. An axial movement of the control rod 7 toward the stop element 31 accordingly brings about its adjustment wherein which the helical pressure spring 30 is compressed, and the response pressure is thus increased.

To move the control rod 7, its tool insert section 8 extends into the tool holder 12 in which the tool insert section 8 of the control rod 7 engages with a tool insert 11 so that the tool insert 11 fixes the position of the control rod. In the exemplary embodiment shown in FIGS. 1 to 3*b*, the tool insert 11 has a recess 13 into which the tool insert section 8 of the control rod 7 engages. The longitudinal extension of the recess 13 is such that the control rod 7 is not moved toward the pressure control valve 3 so that it has the response pressure set by the setscrew 32.

Figure 4:
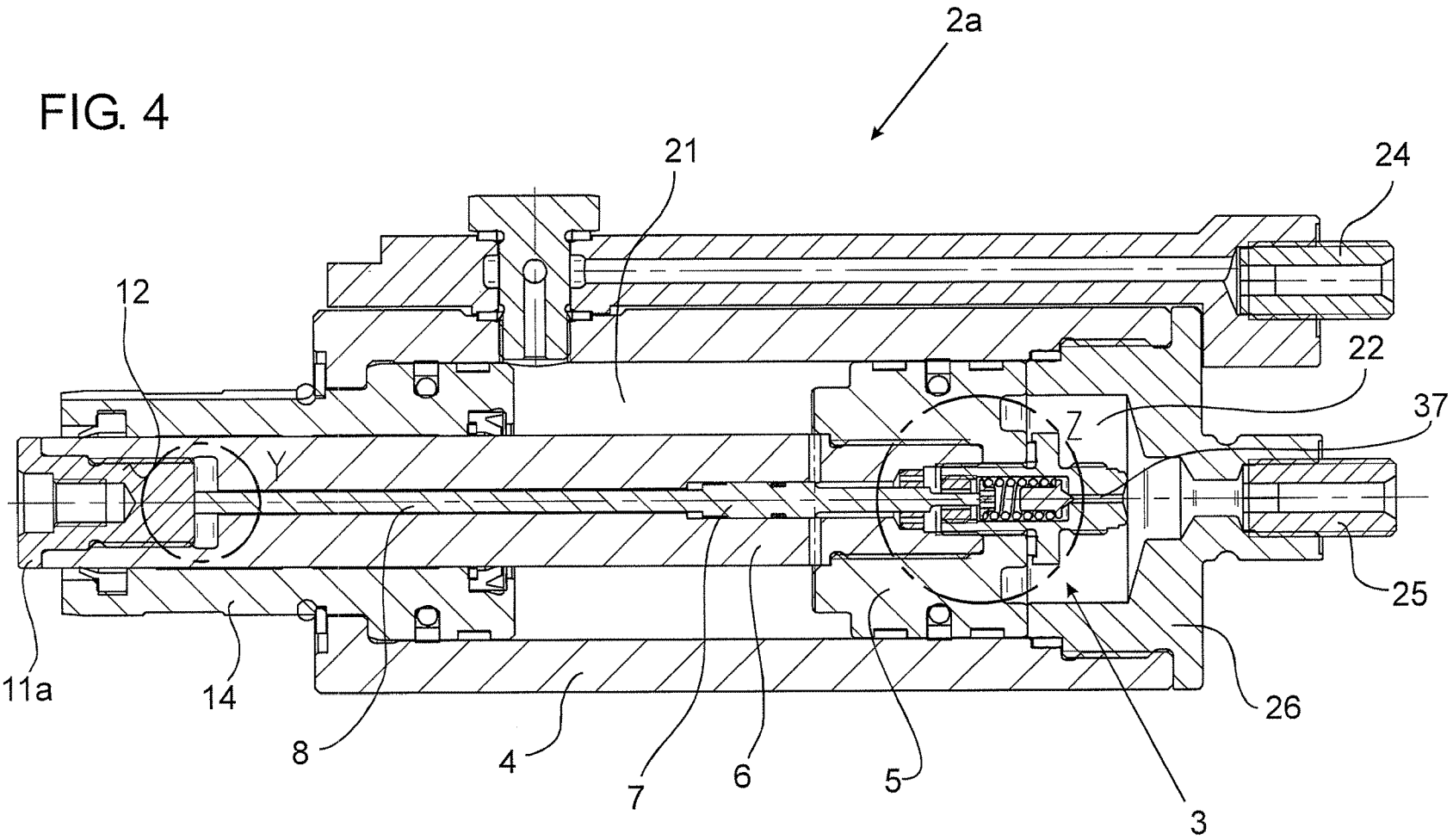
FIG. 4 shows another view of a section of the hydraulic unit from FIG. 1.
Figure 4B:
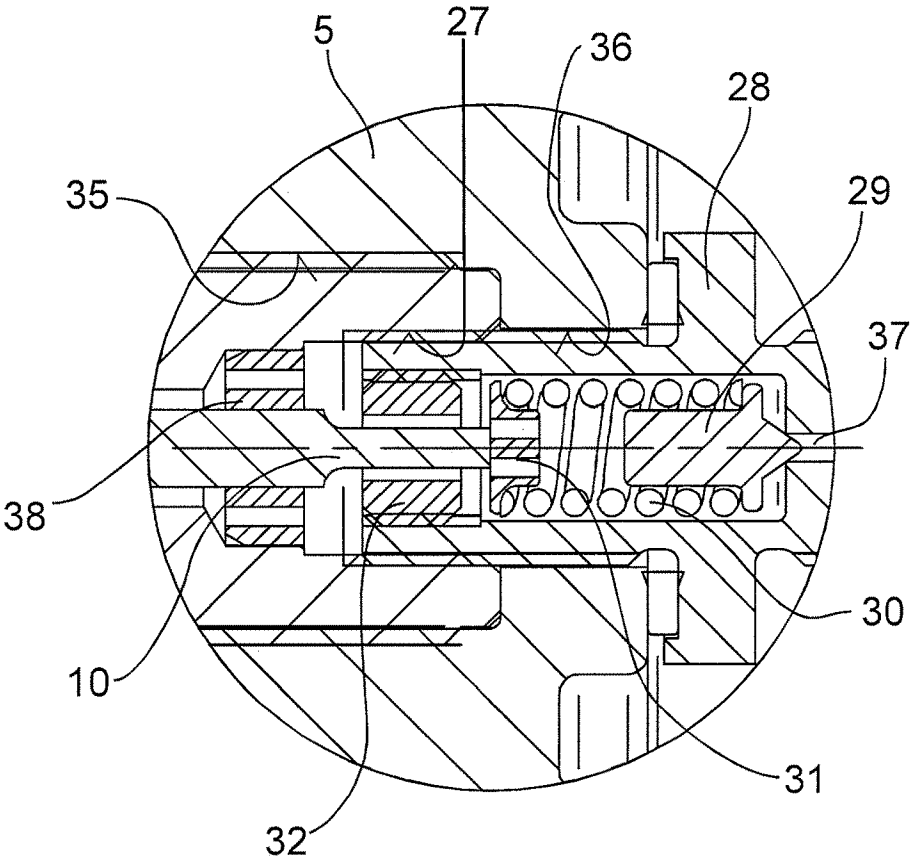
FIG. 4*b* shows a view of detail Z from FIG. 4.
Figure 4A:
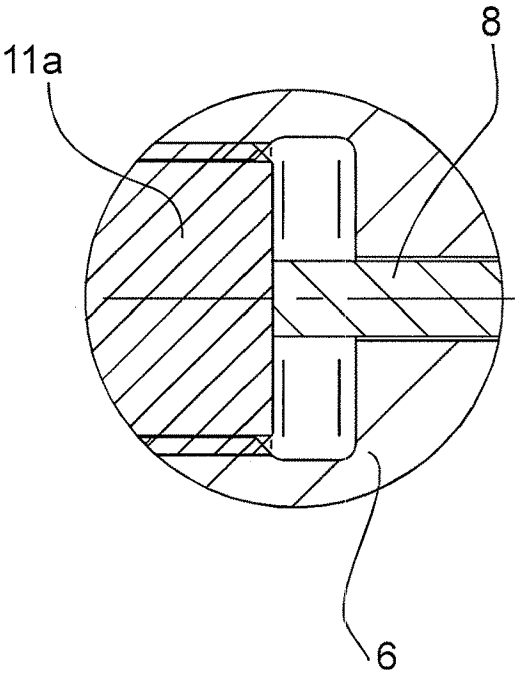
FIG. 4*a* shows a view of detail Y from FIG. 4.
Figure 5:
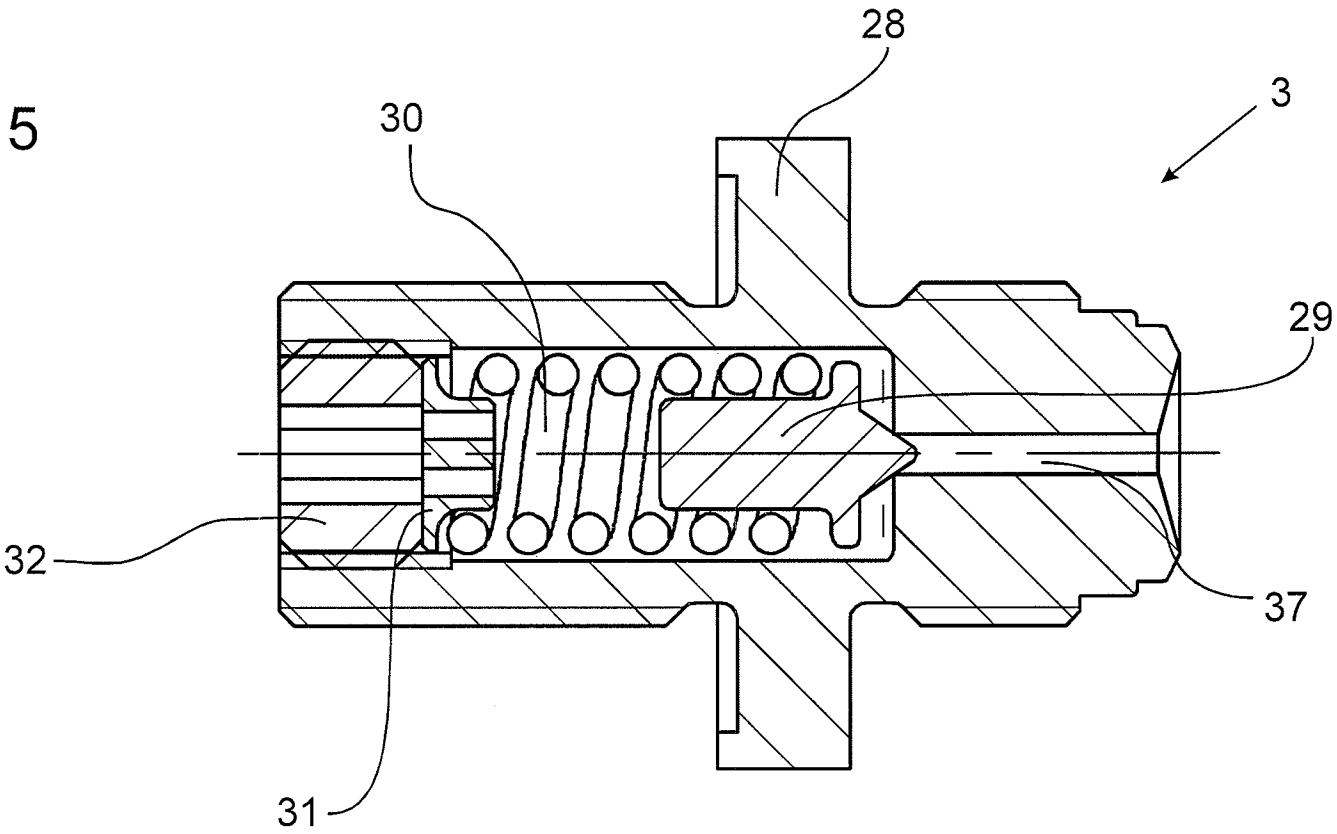
FIG. 5 shows a view of a section of a pressure control valve of the hydraulic tool from FIG. 1.

In the exemplary embodiment of the hydraulic unit 2 shown in FIGS. 4, 4*a* and 4*b*, the tool insert 11*a*, however, does not have a recess 13, but its end face facing the control rod 7 abuts the control rod and moves it in the assembled position toward the pressure control valve 3 so that the stop element 31 is moved, the helical pressure spring 30 is compressed, and the response pressure is thereby increased.

Once the response pressure is reached, the valve element 29 is moved toward the helical pressure spring 30 so that hydraulic fluid from the pressure chamber 22 can flow through the inlet duct arranged in the valve body 28 past the valve element 29. The hydraulic fluid then continues coaxially to the valve section 9 of the control rod 7 up to an overpressure duct 20 which terminates in a cylinder chamber 21. From there, the hydraulic fluid passes through the return lines 23*a*, 23*b* to the coupling 24 which in turn is connected to a hydraulic line. The pressure control valve 3 is fixed in its position by screwing in the valve body 28 into a valve body seat 36 on the hydraulic piston 5 and into a valve body seat 27 on the piston rod 6. A connecting section 34 of the piston rod 6 is, in turn, screwed into the seat section 35 of the hydraulic piston 5. A guide ring 38 in the valve body seat 27 serves to bear the valve section 9 of the control rod 7.

REFERENCE NUMBER LIST

1 Hydraulic tool
2 Hydraulic unit
3 Pressure control valve
4 Cylinder
5 Hydraulic piston
6 Piston rod
7 Control rod
8 Tool insert section (control rod)
9 Valve section (control rod)
10 End section (control rod)
11 Tool insert
12 Tool holder
13 Recess
14 Guide sleeve
15 Spring ring
16 Groove
17 Shoulder (guide sleeve)
18 Edge
19 Opening
20 Overpressure channel
21 Cylinder chamber
22 Pressure chamber
23*a*, 2*b* Return line
24 Coupling
25 Coupling
26 Cylinder cover
27 Valve body seat (piston rod)
28 Valve body
29 Valve element
30 Helical compression spring
31 Stop element
32 Setscrew
33 Housing body
34 Connecting section (piston rod)
35 Seat section (hydraulic piston of the piston rod)
36 Valve body seat (hydraulic piston)
37 Inlet duct
38 Guide ring

I claim:

1. A hydraulic unit for a mobile hydraulic tool, comprising:

a hydraulic piston hydraulically adjustable between a starting position and an end position and a piston rod that is connected to the hydraulic piston and has a tool holder for a tool insert, characterized in that a pressure control valve connecting the pressure chamber to a cylinder chamber and limiting the pressure acting on the hydraulic piston on the pressure chamber side is arranged on the hydraulic piston and is connected to the piston rod, and wherein the piston rod has a control rod which at one end is arranged in the tool holder and can be brought into engagement with a tool insert, and at an other end is connected to the pressure control valve such that an adjustment of the control rod causes a change in the response pressure of the pressure control valve.

2. The hydraulic unit according to claim 1, wherein a shift of the control rod in a direction of a longitudinal axis causes a change in the response pressure of the pressure control valve.

3. The hydraulic unit according to claim 1, wherein the pressure control valve has a stop element that can be adjusted in the direction of a longitudinal axis of the control rod, and against which the control rod abuts at the one end and, at the other end, a spring element abuts which, at an end opposite the stop element, abuts a valve element that closes an inlet duct of the pressure control valve, wherein the settable length of the spring element defines the bias of the response pressure.

4. The hydraulic unit according to claim 3, wherein the spring element is formed by a helical pressure spring braced at one end against the stop element and at the other end against the valve element.

5. The hydraulic unit according to claim 3, wherein a setscrew which can be moved in a longitudinal axial direction is arranged on a side of the stop element opposite the spring element.

6. The hydraulic unit according to claim 1, wherein the hydraulic piston and the control rod are designed such that, after the response pressure is reached, hydraulic fluid enters an overpressure duct in the hydraulic piston open to the cylinder chamber coaxial to the piston rod.

7. The hydraulic unit according to claim 1, wherein the tool insert has recesses adapted to the tool insert section of the control rod along the extension of which the response pressure can be adjusted in the longitudinal direction of the axis.

8. The hydraulic unit according to claim 1, wherein the tool holder has a thread for arranging the tool insert.

* * * * *